United States Patent [19]

Meier

[11] Patent Number: 4,528,798

[45] Date of Patent: Jul. 16, 1985

[54] METHOD AND APPARATUS FOR STORING CONTINUOUSLY ARRIVING FLAT STRUCTURES, ESPECIALLY PRINTED PRODUCTS ARRIVING IN AN IMBRICATED PRODUCT FORMATION

[75] Inventor: Jacques Meier, Baeretswil, Switzerland

[73] Assignee: Ferag AG, Hinwil, Switzerland

[21] Appl. No.: 580,210

[22] Filed: Feb. 15, 1984

[30] Foreign Application Priority Data

Feb. 21, 1983 [CH] Switzerland ..... 951/83

[51] Int. Cl.[3] ..... B65B 63/04

[52] U.S. Cl. ..... 53/430; 53/118; 242/59

[58] Field of Search ..... 53/430, 118, 116, 117, 53/119; 242/59, 67.1 R

[56] References Cited

U.S. PATENT DOCUMENTS

| | | | |
|---|---|---|---|
| 3,013,367 | 12/1961 | LaSarre | 53/118 X |
| 4,063,693 | 12/1977 | Achelpohl et al. | 53/118 X |
| 4,438,618 | 3/1984 | Honegger | 53/430 |

FOREIGN PATENT DOCUMENTS

| | | |
|---|---|---|
| 2207556 | 6/1975 | Fed. Rep. of Germany . |
| 2544135 | 4/1977 | Fed. Rep. of Germany . |
| 3123888 | 5/1982 | Fed. Rep. of Germany . |
| 3151860 | 9/1982 | Fed. Rep. of Germany . |
| 3236866 | 5/1983 | Fed. Rep. of Germany . |
| 3244663 | 7/1983 | Fed. Rep. of Germany . |
| 2081230 | 2/1982 | United Kingdom . |
| 2092557 | 8/1982 | United Kingdom . |
| 2107681 | 5/1983 | United Kingdom . |
| 2112758 | 7/1983 | United Kingdom . |

*Primary Examiner*—James F. Coan

*Attorney, Agent, or Firm*—Werner W. Kleeman

[57] ABSTRACT

The precursive or leading portion of printed products or other processed articles arriving in an imbricated formation is first wound up on an auxiliary winding drum or core to form an intermediate coil or package defining a first subformation. The subsequent, second portion of the imbricated formation defining a second subformation is then deposited on this first subformation as the latter is wound off the intermediate coil or package. Both superposed subformations are now jointly fed to a rotatable and driven main winding drum or core and wound up thereupon to form a main storage coil or product package. In order to obtain a compact main storage coil, the two superposed subformations are fed to the main winding drum such that the leading edges of both subformations lie on the upper sides thereof, i.e. the sides oriented towards the main winding drum.

23 Claims, 3 Drawing Figures

METHOD AND APPARATUS FOR STORING CONTINUOUSLY ARRIVING FLAT STRUCTURES, ESPECIALLY PRINTED PRODUCTS ARRIVING IN AN IMBRICATED PRODUCT FORMATION

CROSS-REFERENCE TO RELATED APPLICATIONS

This application is related to the following commonly assigned, copending U.S. applications:

(i) Ser. No. 06/280,998, filed on July 6, 1981, and entitled "Apparatus for Stacking Printed Products, Such as Newspapers, Periodicals and the Like, Arriving in an Imbricated Product Stream";

(ii) Ser. No. 06/432,557, filed on Oct. 4, 1982, and entitled "Apparatus for the Storage of Flat Products Arriving in an Imbricated Formation, Especially Printed Products";

(iii) Ser. No. 06/445,564, filed on Nov. 29, 1982, and entitled "Method of, and Apparatus for, Removing Flat Products, Especially Printed Products, from a Winding Core"; and (iv) Ser. No. 06/445,565, filed on Nov. 29, 1982, and entitled "Method and Apparatus for Storing Continuously Arriving Flat Products, Especially Printed Products, and Product Package Formed from such Products".

BACKGROUND OF THE INVENTION

The present invention broadly relates to a method and apparatus for storing continuously arriving flat structures and, more specifically, pertains to a new and improved method and apparatus for storing printed products arriving in an imbricated product formation.

Generally speaking, the invention concerns itself with an improved method for the storage of printed products arriving in an imbricated product formation, such as typically relatively thick products like newspapers, periodicals and the like, wherein the printed products are infed to a winding core or drum and wound up upon such winding core or drum in conjunction with a winding band or tape which is under tension and operatively connected with such winding core or drum.

Equally, the invention concerns an improved apparatus for the storage of such printed products arriving in an imbricated product formation, such as newspapers, periodicals and the like, wherein there is provided a rotatable and driveably mounted winding core or drum, a conveyor device or arrangement for infeeding the printed products to the winding core or drum, and a winding band or tape which is under tension and operatively connected with the winding core or drum. This winding band or tape can be conjointly wound up onto the winding core or drum along with the printed products and can be wound off such winding core or drum along with the printed products.

It is already known in this technology to wind up upon a winding core or drum printed products arriving in an imbricated product formation. Significant in this regard are German Patent No. 2,207,556, published Aug. 30, 1973, German Patent Publication No. 3,123,888 and the cognate British Patent Publication No. 2,081,230 as well as German Patent Publication No. 3,151,860 and the cognate British Pat. No. 2,092,557. If the number of printed products to be stored in this manner is greater than the storage capacity of the product package or coil upon a winding core or drum, then upon attaining the maximum storage capacity of the product package or coil measures must be taken during the processing operation in order to be able to wind up the further continuously arriving printed products upon a new empty winding core or drum. For this purpose it is known during the storage of bags produced by a high capacity bag-making machine to provide two alternately chargeable winding stations. Of these two winding stations one of them is always fed with products, whereas the other winding station has removed therefrom the full package or coil. Significant in this regard is German Patent Publication No. 2,544,135. This procedure requires an appreciable amount of supplementary machinery due to the required doubling of the winding stations.

SUMMARY OF THE INVENTION

Therefore, with the foregoing in mind it is a primary object of the present invention to provide a new and improved method and apparatus for storing products continuously arriving in an imbricated formation which does not have associated with it the aforementioned drawbacks and shortcomings of the prior art constructions.

Another and more specific object of the present invention aims at providing a new and improved method and apparatus for storing printed products arriving in an imbricated product formation, which permits continuous processing of the arriving printed products to form a substantially uniformly compact product coil or package without having to provide a plurality of winding drum stations and without having to interrupt the product flow.

Yet a further significant object of the present invention aims at providing a new and improved apparatus for storing continuously arriving imbricated product formations, which apparatus is relatively simple in conception and design, extremely economical to manufacture and realize, highly reliable in operation, not readily subject to breakdown or malfunction and requires a minimum of maintenance and servicing.

Now in order to implement these and still further objects of the invention, which will become more readily apparent as the description proceeds, the method of the present invention is manifested by the features that, there is delayed the transport of a first, precursive or leading portion of the imbricated product formation to the main winding drum or core, and prior to winding up thereof this first precursive portion of the imbricated product formation is united with a second, subsequent portion of the imbricated product formation such that both the first and second portions or subformations are superposed and such that at least in that portion or subformation most remote from the main winding drum the leading edges of the printed products are located at that side of such subformation which confronts or is nearest to the main winding drum. Thereafter, both of the superposed portions or subformations are simultaneously and conjointly wound up together with the winding band or tape disposed at the outer side of both subformations which is located most remote from the main winding drum.

Not only is the invention concerned with the aforementioned method aspects, but as already alluded to above, deals with an improved apparatus for the performance thereof. According to the invention such apparatus for the storage of printed products arriving in an imbricated product formation comprises a device arranged forwardly of the conveyor arrangement or conveyor means and serving for superposing a first leading portion or subformation of the imbricated product formation and a second trailing portion or subformation of such imbricated product formation prior to the conjoint winding of these two portions or subformations such that at least in the subformation located most remote from the main winding core the leading edges of the printed products are located at the side of such subformation which confronts or is nearest to the main winding core.

While the delivery or infeed of the precursive or leading portion of the imbricated product formation to the main storage winding drum or core is being delayed, a full main storage winding drum or core can be exchanged for an empty winding drum or core. Subsequently, the first, precursive portion of the imbricated product formation is united with that following second portion of the imbricated product formation being delivered directly and without delay to the new, empty, main storage winding drum or core and both imbricated product formation portions or subformations are wound up conjointly on that winding drum. This means that the coil layers or plies of the storage coil or package are formed by the adjacent or superposed portions or subformations of the imbricated product formation.

A winding band maintained under tension is interleaved between the individual coil layers or plies and wound into the product coil or package as a separating layer or element. The printed products of the outer situated portion or subformation of each coil layer or ply bear by means of their trailing edges at the inner situated side of the winding band or tape which confronts the winding core or drum. This position of the printed products in the outer situated portion or subformation of each coil layer or ply allows each coil layer or ply to be able to shift or displace in the direction of coiling or winding, in relation to the outer situated coil layer or ply, without there occurring any mutual hindrance or blocking. This permits the tensioned winding band and also the superposed or double-layered imbricated product formation lying between the individual coils of the winding band or tape to be wound up in the manner of a clock or spiral spring. This produces a compact package or coil in which the firmly tightened and therefore greatly radially compressed coil layers of the printed products are in intimate contact.

This secondary winding procedure, analogous in principle to winding up a clock spring, therefore advantageously contributes to the compression and compaction of the product coil or package, and therefore to an increase of the storage capacity. It is now possible to form compact product coils or packages of large diameter practically without damage to the printed products.

In order to even more effectively avoid damage to the printed products during winding, the two imbricated product formation portions or subformations are preferably so juxtaposed or superposed that the leading edges of the printed products in each portion or subformation are oriented on the side of the corresponding imbricated product formation portion or subformation nearest the winding drum or core.

It is particularly advantageous to employ an underfeed delivery of both imbricated product formation portions or subformations to the winding drum or core.

A delayed delivery or feed of the first imbricated product formation portion or subformation to the main storage winding drum or core is achieved in a particularly simple and practical manner by first winding the first or precursive imbricated product formation portion or subformation on an intermediate or temporary storage coil and then unwinding it therefrom and feeding or delivering it jointly with the second imbricated product formation portion or subformation to the main storage winding drum. To form this intermediate or temporary storage coil, the first imbricated product formation portion or subformation is advantageously fed or delivered to an intermediate storage winding drum with an underfeed delivery.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
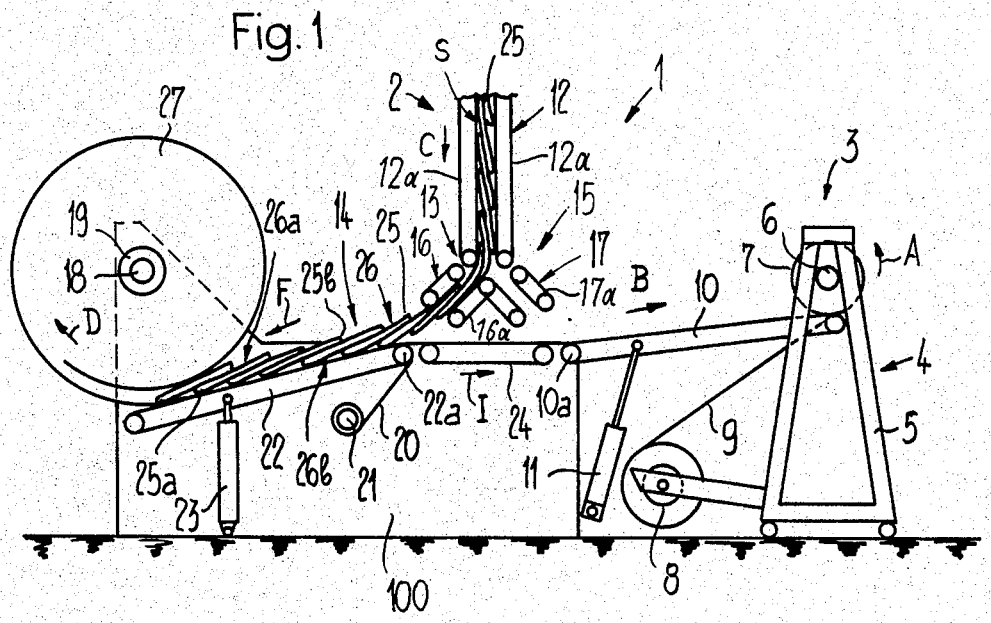
FIGS. 1 and 2 schematically show a side view of a winding station according to the invention in various phases of operation.

Describing now the drawings, it is to be understood that to simplify the showing of the drawings only enough of the structure of the winding station has been illustrated therein as is needed to enable one skilled in the art to readily understand the underlying principles and concepts of this invention. The illustrated exemplary embodiment of the winding and storage apparatus will be seen to comprise a winding station 1 which has been illustrated in detail in FIGS. 1 and 2. This winding station 1 comprises a product delivery or infeed device 2 leading to a winding position or location 3. A winding and storage unit 4 is located at this winding position or location 3 and comprises a mobile mounting frame 5 having the form of a bearing standard or journal block frame. A shaft 6 of a cylindrical winding drum or core 7—also referred to in the art as a winding mandrel—is rotatably mounted in the mobile mounting frame 5. The winding drum or core 7 can be driven in the direction of the arrow A by any suitable drive means or drive motor not particularly shown in the drawings.

A winding band supply drum or spool 8 with a winding band or tape 9 is also mounted on this mobile mounting frame 5. This winding band or tape 9 which is made of a suitable tension-resistant material, for instance plastic, has one of its ends firmly anchored at the winding drum or core 7. As such driven winding drum or core 7 is rotated, this winding band or tape 9 is pulled off the winding band supply drum or spool 8. Any suitable tensioning means, not specifically shown in the drawings, for instance a braking device, are provided to generate a tensile force in the winding band or tape 9 as it winds up on the winding drum 7. The construction and function of the winding and storage unit 4 correspond to the structure described in the German Patent Publication 3,236,866 and the corresponding British Patent Publication 2,107,681, to which reference may be readily had and the disclosure of which is incorporated herein by reference.

A pivoted belt conveyor 10, defining a rocker or balance structure, is arranged beneath and ahead or upstream of the winding drum or core 7. The belt conveyor 10 can be pivoted about an axis or shaft 10*a* mounted in the winding station frame 100. The belt conveyor 10 is appropriately driven in the direction of the arrow B by any suitable drive means or drive motor not particularly shown in the drawings. A pressure or contact mechanism 11 containing a not particularly depicted but conventional energy-storing spring engages the belt conveyor 10 or equivalent structure to press it into contact with the winding drum or core 7 and, as the case may be, with the wound storage coil or package 29 formed thereupon.

The delivery or infeed device 2 comprises a delivery or infeed conveyor 12 which is only schematically shown in the drawings. In this illustrative example, the delivery or infeed conveyor 12 is formed by the two depicted belt conveyors 12*a* arranged in mutually spaced relationship. This delivery conveyor 12 has, at least in the region shown in FIGS. 1 and 2, a delivery or feed direction C which is substantially vertical. A diverting or switching mechanism 13 which has the action of a transfer mechanism or switch, is arranged at the outfeed end of the delivery conveyor 12. A first branch 14 and a second branch 15 of the delivery conveyor 2 immediately follow the diverting or transfer mechanism 13. This diverting or transfer mechanism 13 selectively connects the delivery or infeed conveyor 12 with the first branch 14 or the second branch 15. Each of these product-delivery branches 14, 15 comprises a conveyor 16 and 17, respectively, adjacent to the outfeed end of the diverting or transfer mechanism 13 which together form a branch or fork and each contains two belt conveyors 16*a* and 17*a*, respectively, running in mutually spaced relationship.

A shaft 18 of an auxiliary or intermediate winding drum or core 19—also referred to in the art as a winding mandrel—is rotatably mounted in the winding station frame 100 at a position on the side of the delivery conveyor 12 opposite the main storage winding drum or core 7. This auxillary or intermediate winding drum or core 19 is also selectively driven in the direction of the arrows D and E, respectively, by any suitable drive means or drive motor not particularly shown in the drawings. A winding band or tape 20 coiled on a supply drum or spool 21 mounted in the winding station frame 100 has one of its ends anchored to the auxiliary or intermediate winding drum or core 19.

A further belt conveyor 22, defining a rocker or balance structure, is swingingly mounted in the winding station frame 100, pivoting about an axis or shaft 22*a* and disposed beneath the intermediate or auxiliary winding drum or core 19. A pressure or contact mechanism 23 engages this belt conveyor 22 in a manner analogous to the belt conveyor 10. This pressure or contact mechanism 23 also contains a conventional energy-storing spring which presses the belt conveyor 22 into contact with the auxiliary or intermediate winding drum or core 19, or, as the case may be, against the intermediate storage coil or product package 27 formed thereupon. The belt conveyor 22 is selectively driven in the direction of the arrows F and G, respectively, by any suitable drive means or drum motor not particularly shown in the drawings.

Yet a further belt conveyor 24 is arranged immediately adjacent to that end of the belt conveyor 22 opposite the intermediate or auxiliary winding drum or core 19. This belt conveyor 24 is driven in the direction of the arrow I and connects the two pivoting or rocker-type belt conveyors 22 and 10 with one another.

The winding or coiling of the continuously arriving imbricated product formation or stream S of printed products 25 in the winding station 1 proceeds as follows:

The printed products 25 or other processed products or articles are delivered to the diverting or transfer mechanism 13 by the delivery or infeed conveyor 12. The first, precursive or leading portion 26 of the printed products 25 is directed or diverted as a first subformation to the first branch 14 of the delivery device or infeed device 2. The conveyor 16 conveys the printed products 25 of the first imbricated product formation portion or subformation 26 to the belt conveyor 22 which delivers these printed products 25 in the direction of the arrow F in, for instance, an underfeed manner to the auxiliary or intermediate winding drum or core 19 as is shown in FIG. 1.

As can be seen from FIG. 1, the printed products 25 in the imbricated product formation portion or subformation 26 approaching the auxiliary or intermediate winding drum 19 overlap one another like shingles. This overlapped or imbricated formation of these printed products 25 is such that the leading edges 25*a* of the printed products 25, which are also for instance the folded or fold edges, are disposed on the underside 26*b* of the imbricated product formation portion or subformation 26. Consequently, the trailing edges 25*b* of the printed products 25, which then constitute edges where the printed products 25 are open, are located at the top or upper side 26*a* of the imbricated product formation portion or subformation 26.

The auxillary or intermediate winding drum or core 19 is driven in the direction of the arrow D with the result that the first imbricated product formation portion or subformation 26 is wound on this intermediate or auxiliary winding drum 19 to form an intermediate storage coil or product package 27. The winding band or tape 20, maintained under tension by any suitable means not shown in the drawings, such as a brake, is unrolled or uncoiled from the supply drum or spool 21 simultaneously with the winding of the imbricated product formation portion or subformation 26 and is conjointly wound or coiled with this imbricated product formation portion 26. This winding band or tape 20 is therefore interleaved between the individual layers or plies or coils of the intermediate storage coil or product package 27.

After the last printed product 25 of this first, precursive portion or subformation 26 has passed the diverting or transfer mechanism 13, the diverting or transfer mechanism is switched to the second branch 15 of the delivery mechanism 2. That means that the second, subsequent imbricated product formation portion or subformation 28 is delivered by the second branch 15, i.e. the conveyor 17, directly to the belt conveyor 10. The belt conveyor 10 is driven in the direction of the arrow B. At the same time the first imbricated product formation portion or subformation 26 is unwound from the intermediate storage coil or package 27 and transported to the belt conveyor 10 by the belt conveyors 22 and 24 which are driven in the direction of the arrows G and I, respectively.

Figure 2:
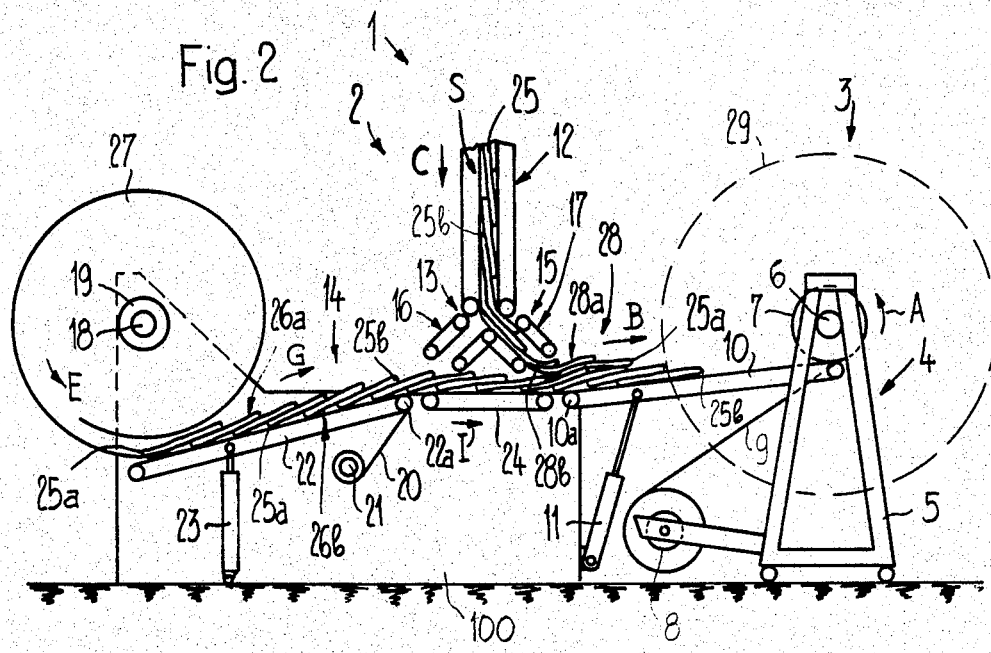

The unwinding or the uncoiling of the first imbricated product formation portion or subformation 26 from the intermediate storage coil or package 27 is induced by driving the band supply drum or spool 21 of the winding band or tape 20 in an appropriate direction while applying a gentle braking effect to the auxiliary or intermediate storage winding drum or core 19. As shown in FIG. 2, the open or cut, i.e. not folded, page edges 25*b* of the printed products 25 in the first imbricated product formation portion or subformation 26 unwinding from the intermediate storage coil 27 and moving toward the main storage winding drum or core 7 form the leading edges. These leading edges are disposed at the upper side 26*a* of the first imbricated product formation portion or subformation 26.

The conveyor 17 now delivers the second imbricated product formation portion or subformation 28 and deposits it upon the first imbricated product formation portion or subformation 26 arriving on the belt conveyor 10 as shown in FIG. 2. In this second imbricated product formation portion or subformation 28, each printed product 25 rests upon the preceding printed product such that the folded edge 25*a* of the printed products 25 form the leading edges. In this second imbricated product formation portion 28 these leading edges 25*a* of the printed products 25 are also disposed on the upper side 28*a* of this imbricated product formation portion 28.

Correspondingly, the trailing edges 25*b* of the printed products 25, which are the open or cut page edges, are disposed on the underside 28*b* of the second imbricated product formation portion or subformation 28. Both juxtaposed or superposed imbricated product formation portions or subformations 26 and 28 are then delivered to the main storage winding drum or core 7 by the belt conveyor 10 in an underfeed manner. The main storage winding drum 7 is driven in the direction of the arrow A in order to wind or coil both superposed imbricated product formation portions or subformations 26 and 28. The rotation of the main storage winding drum 7 unwinds the winding band or tape 19 from the supply drum or spool 8 and causes it to be interleaved between and wound up with the individual double-layered or double-ply coil layers. These individual coil layers or coils are separated from one another by the winding band 9. The finished main storage coil or product package 29 is represented in broken lines in FIG. 2.

Both the winding of the first imbricated product formation portion or subformation 26 on the auxiliary or intermediate winding drum or core 19 and the winding of both superposed imbricated product formation portions or subformations 26 and 28 on the main storage winding drum or core 7 are basically performed in the manner described in the German Patent Publication No. 3,123,888 and the corresponding British Patent Publication 2,081,230, to which reference may be made for further details and the disclosure of which is incorporated herein by reference.

When the main storage coil or product package formed on the main storage winding drum 7 has reached its prescribed size, the still continuously arriving printed products 25 are diverted by the diverting or transfer mechanism 13 again to the first branch 14. The printed products 25 thus delivered to the auxillary or intermediate winding drum or core 19, which, in the meantime, has been completely emptied, are wound on this auxiliary or intermediate winding drum 19 in the manner previously described to form an intermediate storage coil or product package 27.

While this new intermediate storage coil 27 is being formed, the mobile mounting frame 5 with the full main storage coil or package 29 can be removed from the winding position or location 3 and replaced by a further mobile mounting frame 5 having an empty main storage winding drum or core 7. The intermediate storage coil or package 27 is then unwound in the manner already described to begin forming a new main storage coil or package on the empty main storage winding drum or core 7. While the mobile mounting frame 5 is being exchanged, the continually arriving flow of products need not be interrupted, even though there is only provided a single winding position or location 3.

Figure 3:
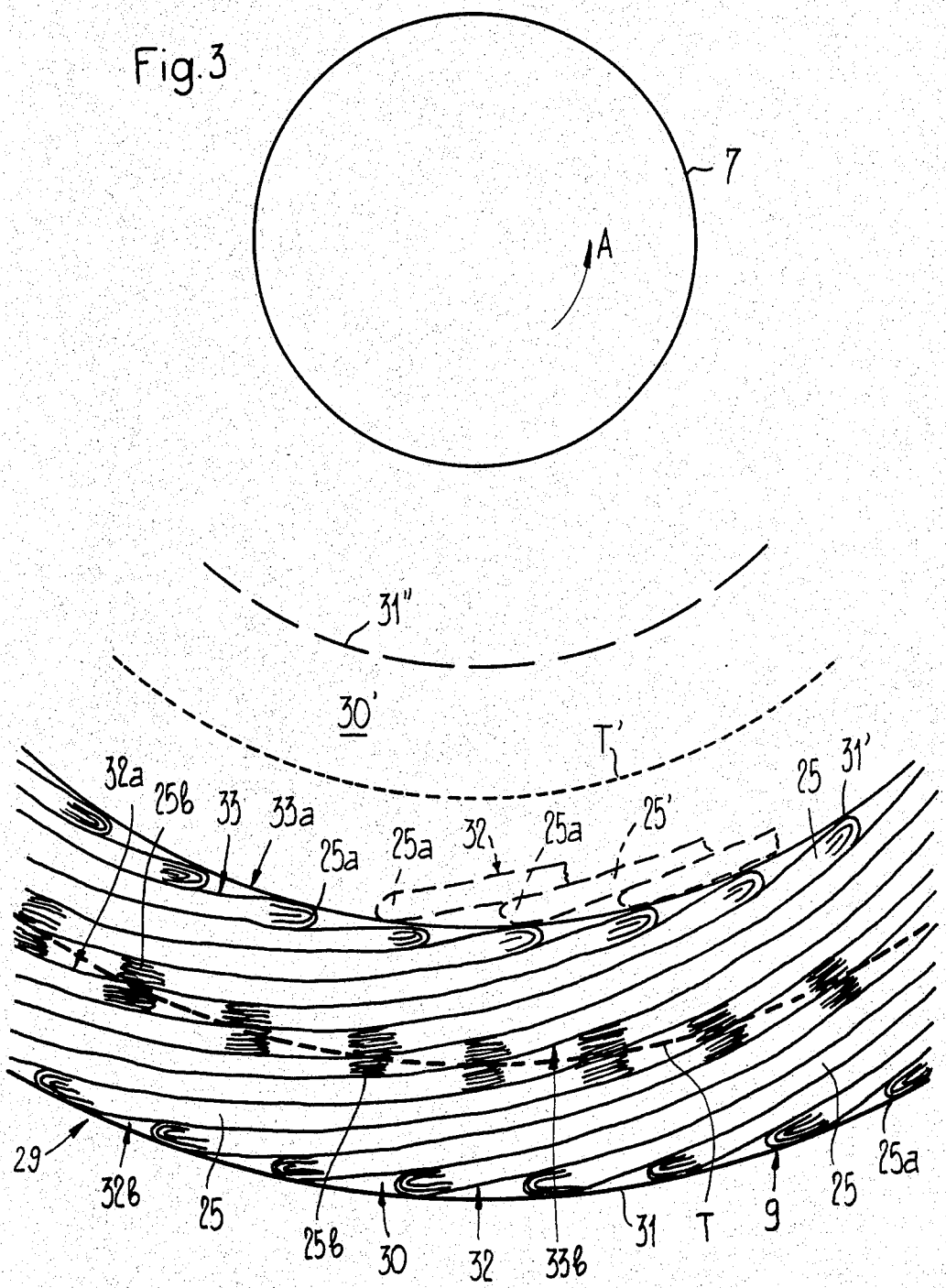
FIG. 3 schematically shows on a larger scale a side view of part of a storage coil or package formed in the winding station according to FIGS. 1 and 2.

FIG. 3 shows a portion of the main storage coil or product package 29 on a larger scale. The individual coil layers or plies, which are separated from one another by the loops or coils 31, 31', 31'' of the winding band or tape 9 are designated by reference numbers 30 and 30'. As already mentioned, each coil layer or ply or coil 30, 30' comprises two juxtaposed or superposed imbricated product formation portions or subformations 32 and 33 lying in mutual contact without any intermediate or separating layers. The dividing line T, T' shown in FIG. 3 in broken lines is only meant to indicate the presence of two imbricated product formation portions or subformations 32, 33 in each coil layer or coil 30, 30'.

It will be understood on the basis of the descriptions made with reference to FIG. 2 that the exterior or outer situated imbricated product formation portion 32 of each coil layer or coil 30, 30' is formed by the first imbricated product formation portion or subformation 26, while the second imbricated product formation portion or subformation 28 corresponds to the interior or inner situated imbricated product formation portion or subformation 33. It can clearly be seen in FIG. 3 that the edges 25*b* and 25*a* forming forward edges with respect to the winding direction A, i.e. the leading edges, in each imbricated product formation portion or subformation 32 and 33, respectively, are oriented towards the main storage winding drum or core 7, and, as the case may be, the next inner coil layer or coil 30'. In the outer imbricated product formation portion or subformation 32 this forward or leading edge 25*b* is formed by the cut or open edge of the printed product 25, while in the inner imbricated product formation portion or subformation 33 it is formed by the folded edge 25*a*.

The outer side 32*b* of the outer imbricated product formation portion or subformation 32, which is formed by the rearward or trailing edges (folded edges) 25*a* of the printed product 25, lies in contact with one side of each loop or coil 31 of the winding band or tape 9. Correspondingly, the inner side 33*a* of the other imbricated product formation portion or subformation 32 is in contact with the opposite side of the winding band loop or coil 31. The inner side of the exterior or outer situated imbricated product formation or subformation 32 and the outer side of the interior imbricated product formation or subformation 33 are designated as 32*a* and 33*b*, respectively.

The disposition of the printed products 25 described with reference to FIGS. 2 and 3 in the conjointly wound imbricated product formation portions or subformations 26 and 28 and thus in the imbricated product formation portions or subformations 32 and 33, is important for achieving a compact coil or wound product package for the reasons given below.

The weight of those printed products 25 that are supported by the coil loops or coils 31 of the winding band or tape 9 is transmitted by these loops or coils 31 to those printed products 25 located above the axis of rotation of the driven main storage winding drum 7 and induce strong pressure forces there. These pressure forces compress the printed products so that the thickness of the upper portion of the main storage coil or product package 29 is reduced and the printed products 25 themselves are pressed flat and into intimate contact with one another. The thickness, respectively the radius, of the lower portion of the main storage coil or product package 29 is, on the other hand, increased, since the compression in the upper region permits a drooping or sagging of the band loops 31 and a loosening of the coil layers or coils 30. The coil or product package 29 therefore departs from its theoretical or reference shape, i.e. the shape of a uniform spiral, and its coil layers or plies or coils 30 droop or sag downward and only remain in intimate contact in the upper region of the storage coil 29 or product package.

Since the winding drum or core 7 rotates, the compression or compaction is effected all around the product coil or package 29, so that the winding band loops 31, in relation to the winding drum or core 7 and the next inner loops 31', 31'', always have a greater peripheral length than they would have in the theoretical form of the coil or product package 29. This has the result that during package winding the extended, next outer coil or package layers translate or slide over their respective adjacent, inner coil or package layers, much as an internally toothed gear ring revolves about a rotating pinion gear.

During this sliding or translation, the winding drum or core 7 can rotate faster than the outer loops of the coil or package, since it is provided with a free-wheeling action, and gradually tightens and compacts the relatively loose coil layers or package coils or plies 30 on the winding drum 7 in a secondary winding process while the imbricated product formation portions or subformations 26, 28 are being wound from the outside. As further package coils are wound, the weight producing the compression in the upper printed products of the product coil or package 29 increases and assists in the compaction of the secondary coiling or winding effect.

This secondary coiling or winding effect in which a recoiling and tightening of the inner coil layers or plies takes place while the outer coil layers or plies 30 are being formed on the periphery of the wound product package 29, can take place without damage to the printed products because each coil layer or ply 30, 30' can be rotated or translated with respect to the outer coil layer surrounding it in the coiling or winding direction A without any mutual interference. During such relative motion between the coil layers or plies 30, 30' the rearward or trailing edges **25*a* of the printed products 25 on the exterior of the outer imbricated product formation portion or subformation 32 of a coil layer 30, 30', i.e. as a rule the folded edges, can slide over the inner edges 25*a* of the printed products 25 of the inner imbricated product formation portion or subformation 32 of the next-outer coil layer without causing damage to the printed products 25 as can be seen in FIG. 3. A further factor contributing to the prevention of such damage is that these interior edges 25*a* of the inner imbricated product formation portion or subformation 33 of the coil layer 30** are leading edges relative to the direction of coiling A.

During the aforementioned secondary winding procedure a mutual relative translation between both imbricated product formation portions or subformations 32, 33 of a coil layer or ply 30 is possible without resulting in a mutual blocking or interference action and consequent damage to the printed products 25 since each printed product 25 rests upon the preceding printed product 25 in the coiling or winding direction A in both imbricated product formation portions or subformations 26, 28 respectively 32, 33 of each coil layer or ply 30.

Due to this freedom of motion or free-wheeling action and the coiling of the winding band or tape 9 under tension, the winding band 9 and with it the coil layers 30 lying between the loops 31 of this winding band 9 can be so-to-speak wound up in the manner of a spiral clock spring. In the resulting compact coil or product package, the printed products 25 are flawlessly retained without auxiliary means, even in coils or product packages of large diameter such as two to three meters. Since this secondary coiling or winding procedure in the winding band or tape 9 results in tensile forces which are considerably greater than the nominal tensile force applied to the winding band 9 from the exterior during the winding procedure, these tensile forces applied from the exterior can be kept relatively low.

It will be seen from the above explanations that in order to produce a flawless secondary coiling or winding procedure, it is necessary that the printed products of the first, lower imbricated product formation portion or subformation 26 rest upon one another in such a manner that their leading edges **25*b* are disposed on the side of the first imbricated product formation portion 26 nearest the main winding drum or core 7, i.e. in underfeed delivery on the upper side 26*a*. This means that in the case of an underfeed delivery of this first imbricated product formation portion or subformation 26 to the auxiliary winding drum 19, this first imbricated product formation portion 26 must be delivered to the auxiliary winding drum 19 such that the leading edges 25*a* of the printed products 25 are disposed upon the lower side 26*b* away from the auxiliary winding drum 19, as can be seen in FIG. 1. In forming the intermediate storage coil or package 27, it is accepted, as in the device according to German Pat. No. 2,707,556, that the blocking action arising between adjacent coil layers prevent the aforementioned tightening of the coil or product package 27 in the manner of winding up a spiral clock spring. This disadvantage, however, is of secondary importance because the auxiliary storage coil or package 27 has a much smaller diameter than the main storage coil or package 29 and furthermore need not be as compactly formed as the main storage coil or package 29 since the auxiliary or intermediate storage coil or package 27** is of temporary nature and not subject to further manipulation.

In order to remove the printed products 25 from the main storage coil or product package 29, the winding band supply drum or spool 8 is driven in an appropriate direction and the main storage winding drum or core 7 is slightly braked. The double-layered coil layers or coils 30 are wound off the main storage coil or product package 29. After being wound off, both imbricated product formation portions or subformations 26 and 28 can be separated from one another again. Preferably a single imbricated product formation S is then formed in which the first portion 26 leads or precedes the second portion 28. This unwinding procedure is described in greater detail in the German Patent Publication No. 3,244,663 and in the corresponding British Patent Publication No. 2,112,758, to which reference may be made for further details.

Although it is particularly advantageous for reasons of handling to accommodate both the main winding drum or core 7 and the winding band supply drum or spool 8 for the winding band or tape 9 in a mobile frame 5, it is also possible to mount the winding band supply drum or spool 8 and the main storage winding drum or core 7 in the fixed winding station frame 100. In this case, the bearings of the shaft 6 of the main storage winding drum 7 must be so constructed that the winding drum 7 can be removed from its bearings without difficulty.

It is also possible to deliver the imbricated product formation portions or subformations 26 and 28 to the upper side of the main storage winding drum 7 or to the upper side of the auxiliary storage winding drum 19 or to both. However, to assure a flawless secondary coiling or winding procedure without damage to the printed products, care must be taken that at least the upper imbricated product formation portion or subformation and preferably both imbricated product formation portions or subformations are delivered to the main storage winding drum 7 in such a manner that the leading edges of the printed products are disposed on the side of the corresponding imbricated product formation portion or subformation facing the main winding drum or core 7. This is essential because it is only in this manner that the secondary winding procedure or effect can take place without interference. Otherwise a mutual blocking effect would arise, similar to that in the solution according to the German Pat. No. 2,207,556.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method of storing continuously arriving flat structures, especially printed products and the like arriving in an imbricated product formation, wherein the printed products are transported to a main winding drum and are wound up on said main winding drum together with a winding band anchored at the main winding drum while maintaining said winding band under tension, comprising the steps of:

delaying the transport of a first, precursive portion of said imbricated product formation, to the main winding drum, said first, precursive portion defining a subformation;

uniting said first delayed precursive portion of the imbricated product formation with a second subsequent portion of the imbricated product formation defining a subformation such that said first portion and said second portion of said subformations are mutually superposed and such that at least in that subformation most remote from the main winding drum leading edges of said printed products of said last-mentioned most remote subformation are oriented on a side of such most remote subformation which is nearest the main winding drum;

winding up both superposed first and second portions of said subformations simultaneously and conjointly with said winding band onto said main winding drum; and said winding band being disposed on a side of both subformations most remote from the main winding drum.

2. The method as defined in claim 1, further including the step of:

superposing said subformations such that in both of said subformations said leading edges of said printed products are disposed on a side of the corresponding subformation nearest to said main winding drum.

3. The method as defined in claim 1, further including the step of:

delivering both of said subformations to said main winding drum in underfeed.

4. The method as defined in claim 1, further including the steps of:

winding said first precursive portion to form an intermediate storage coil;

then unwinding said first precursive portion from said intermediate storage coil; and delivering said unwound first precursive portion conjointly with said second subsequent portion to said main winding drum.

5. The method as defined in claim 1, further including the step of:

depositing said second subsequent portion upon said first precursive portion before winding up both subformations upon the main winding drum.

6. The method as defined in claim 4, further including the step of:

delivering said first precursive portion to an auxiliary storage winding drum with said leading edges of said printed products disposed on a side of the subformation thereof most remote from said auxiliary winding drum for the purpose of forming an auxiliary said intermediate storage coil.

7. The method as defined in claim 6, further including the step of:

delivering said first precursive portion to said auxiliary storage winding drum in underfeed.

8. An apparatus for the storage of flat structures, especially printed products arriving in an imbricated product formation, comprising:

at least one rotatable and driveable main storage winding drum;

conveyor means for delivering said imbricated product formation to said main storage winding drum;

at least one winding band anchored at the main storage winding drum and capable of being wound thereupon conjointly with the arriving imbricated product formation while being maintained under tension as well as capable of being unwound therefrom; and means disposed at a position upstream of said conveyor means for superposing upon a first, precursive portion of the arriving imbricated product formation defining a subformation a second, subsequent portion of the arriving imbricated product formation defining a subformation before said first and second portions of said subformations are wound conjointly on the main storage winding drum such that in that subformation most remote from the main storage winding drum leading edges of said printed products thereof are disposed on a side of said last-mentioned most remote subformation which is nearest the main storage winding drum.

9. The apparatus as defined in claim 8, wherein:

said means superpose the two subformations such that in both of said two subformations leading edges of said printed products are disposed on sides of the corresponding subformations nearest said main winding drum.

10. The apparatus as defined in claim 8, wherein:

said conveyor means is arranged in underfeed relation to said main storage winding drum.

11. The apparatus as defined in claim 8, wherein:

said means for superposing said two subformations is formed by a delivery means having a first branch for delayed delivery of said first precursive portion and a second branch for direct delivery of said second subsequent portion to said conveyor means.

12. The apparatus as defined in claim 11, wherein:

said delivery means comprises a delivery conveyor for the arriving imbricated product formation immediately followed by diverting means for optionally supplying one or the other of said branches with said printed products.

13. The apparatus as described in claim 12, further including:

an auxiliary storage winding drum for the winding and subsequent unwinding of said first precursive portion rotatably and driveably mounted in operable association with said first branch to be rotatable in two opposed rotational directions.

14. The apparatus as described in claim 13, further including:

a conveyor device arranged downstream of said diverting means and having two opposed conveying directions for delivering said first precursive portion to said auxiliary storage winding drum and for transporting said first precursive portion unwound from the latter to said conveyor means for delivering said imbricated product formation to said main storage winding drum; and a winding band disposed on the exterior of the first precursive portion with respect to the auxiliary storage winding drum and anchored at the auxiliary storage winding drum and capable of being wound conjointly with the first precursive portion on the auxiliary storage winding drum and capable of being unwound therefrom.

15. The apparatus as defined in claim 14, wherein:

said conveyor device is arranged in underfeed relation to said auxiliary storage winding drum.

16. The apparatus as described in claim 14, wherein:

said winding band anchored at the auxiliary storage winding drum is maintained under tension.

17. The apparatus as defined in claim 14, wherein:

said delivery conveyor and said diverting means are arranged above both said conveyor means and said conveyor device and between said main storage winding drum and said auxiliary storage winding drum.

18. The apparatus as defined in claim 8, further including:

a supply drum for said at least one winding band associated with the main storage winding drum; and a mobile frame at which there are mounted said main storage winding drum and said supply drum.

19. The apparatus as described in claim 18, wherein:

said supply drum comprises a supply roll.

20. A storage coil having a winding direction, comprising:

at least one imbricated product formation of printed products wound on a storage winding drum to form layers of said coil;

at least one tensioned winding band interleaved between and wound into said layers of the coil;

each of said coil layers including outer and inner juxtaposed, conjointly wound imbricated product formations; and said printed products of said outer imbricated product formation being oriented such that edges thereof oriented rearward in relation to said winding direction are disposed adjacent to a next-outer layer of the coil.

21. The coil as defined in claim 20, wherein:

said rearward oriented edges are folded edges.

22. The storage coil as defined in claim 20, wherein:

said printed products of an interior one of said imbricated product formations in each of said coil layers are oriented such that edges thereof oriented forward in relation to said direction of winding are disposed on a side of said coil layer adjacent to a next-inner coil layer.

23. The storage coil as defined in claim 20, wherein:

said forward oriented edges are folded edges.

* * * * *